US010713993B2

(12) United States Patent
Choi et al.

(10) Patent No.: US 10,713,993 B2
(45) Date of Patent: Jul. 14, 2020

(54) IMAGE PROCESSING APPARATUS, DISPLAY APPARATUS AND METHOD OF CONTROLLING THEREOF

(71) Applicant: SAMSUNG ELECTRONICS CO., LTD., Suwon-si, Gyeonggi-do (KR)

(72) Inventors: Yong Seok Choi, Seoul (KR); Do-Hyung Kim, Hwaseong-si (KR); Joon Ho Song, Hwaseong-si (KR); Sang Jo Lee, Hwaseong-si (KR); Won Chang Lee, Seongnam-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/708,704

(22) Filed: Sep. 19, 2017

(65) Prior Publication Data

US 2018/0090047 A1 Mar. 29, 2018

(30) Foreign Application Priority Data

Sep. 23, 2016 (KR) ..... 10-2016-0122277

(51) Int. Cl.
*G09G 5/10* (2006.01)
*G09G 3/36* (2006.01)
(Continued)

(52) U.S. Cl.
CPC ..... *G09G 3/2003* (2013.01); *G09G 5/005* (2013.01); *G09G 5/391* (2013.01);
(Continued)

(58) Field of Classification Search
CPC ..... H04N 5/23293; H04N 5/23216; H04N 5/23245; G09G 2340/0435
See application file for complete search history.

(56) References Cited

U.S. PATENT DOCUMENTS 5,625,572 A * 4/1997 Yonekura ..... G05B 23/0264 348/E7.078
6,225,970 B1 * 5/2001 Song ..... G09G 3/3611 345/103

(Continued)

FOREIGN PATENT DOCUMENTS

EP 3 070 594 3/2016

OTHER PUBLICATIONS

Search Report daated Jan. 11, 2018 in counterpart International Patent Application No. PCT/KR2017/010320.

(Continued)

*Primary Examiner* — Nan-Ying Yang
(74) *Attorney, Agent, or Firm* — Nixon & Vanderhye P.C.

(57) ABSTRACT

It is an aspect of the present disclosure to provide an image processing apparatus, a display apparatus and a method of controlling of the display apparatus capable of preventing a rapid decrease in the image quality of image data.
In accordance with an example aspect of the present disclosure, a display apparatus comprises: a plurality of image processing modules, each image processing module configured to perform an image processing process; a controller configured to output image data processed by any one image processing module of the plurality of image processing modules, based on state information of the plurality of image processing modules; and a display configured to display the output image data.

11 Claims, 19 Drawing Sheets

(51) Int. Cl.

| | |
|---|---|
| ***G09G 3/20*** | (2006.01) |
| ***G09G 5/00*** | (2006.01) |
| ***G09G 5/391*** | (2006.01) |

(52) U.S. Cl.
CPC . *G09G 2320/043* (2013.01); *G09G 2320/066* (2013.01); *G09G 2360/02* (2013.01); *G09G 2360/18* (2013.01)

(56) References Cited

U.S. PATENT DOCUMENTS

| | | | | |
|---|---|---|---|---|
| 2002/0024478 | A1* | 2/2002 | Saito | G09G 1/20 345/10 |
| 2002/0112242 | A1 | 8/2002 | Meddaugh et al. | |
| 2009/0128583 | A1* | 5/2009 | Choi | G09G 3/3406 345/690 |
| 2009/0204790 | A1 | 8/2009 | Khan | |
| 2010/0098163 | A1 | 4/2010 | Chiu et al. | |
| 2011/0285734 | A1* | 11/2011 | Shiohara | H04N 5/66 345/581 |
| 2011/0310268 | A1* | 12/2011 | Shiohara | H04N 5/23293 348/222.1 |
| 2014/0176548 | A1 | 6/2014 | Green | |
| 2016/0104457 | A1 | 4/2016 | Wu et al. | |
| 2016/0170688 | A1 | 6/2016 | Komano | |

OTHER PUBLICATIONS

Korean Office Action dated Apr. 29, 2020 for KR Application No. 10-2016-0122277.

* cited by examiner

IMAGE PROCESSING APPARATUS, DISPLAY APPARATUS AND METHOD OF CONTROLLING THEREOF

CROSS-REFERENCE TO RELATED APPLICATION

This application is based on and claims priority under 35 U.S.C. § 119 to Korean Patent Application No. 10-2016-0122277, filed on Sep. 23, 2016 in the Korean Intellectual Property Office, the disclosure of which is incorporated by reference herein in its entirety.

BACKGROUND

1. Field

The present disclosure relates generally to an image processing apparatus performing an image processing process, a display apparatus and a method of controlling of the display apparatus.

2. Description of Related Art

A display apparatus refers to an apparatus capable of visually displaying image data in various formats by having a display panel.

The display apparatus may process the image data that is transmitted from various external image sources or stored therein and then display the image data on the display panel. For example, the display apparatus performs a variety of image processing processes, e.g., decoding and scaling, on broadcast signals received from the outside so as to display an image in a broadcast channel desired by a user, on the display apparatus.

Recently, a display apparatus may provide an image having the immersion to a user by improving image quality of the image data that is transmitted from various external image sources or stored therein.

SUMMARY

Therefore, it is an example aspect of the present disclosure to provide an image processing apparatus, a display apparatus and a method of controlling of the display apparatus capable of preventing and/or reducing a rapid decrease in the image quality of image data.

Additional aspects of the present disclosure will be set forth in part in the description which follows and, in part, will be apparent from the description.

In accordance with an example aspect of the present disclosure, a display apparatus comprises: a plurality of image processing modules comprising image processing circuitry configured to perform an image processing process; a controller configured to output image data, which is processed by any one image processing module of the plurality of image processing modules, based on state information of the plurality of image processing modules; and a display configured to display the output image data.

The plurality of image processing modules are respectively connected to a buffer storing image data output from the plurality of image processing modules, and the controller may select any one buffer among buffers connected to the plurality of image processing modules based on the state information of the plurality of image processing modules, and outputs image data stored in the selected buffer.

The controller may receive state information from the plurality of image processing modules, and determines whether an image processing state is in a normal state by comparing the received state information, wherein the normal state is a state in which image data about a region required to be output is output normally.

The plurality of image processing modules may comprise a first image processing module comprising first image processing circuitry configured to perform a first image processing process on image data and a second image processing module comprising second image processing circuitry configured to perform a second image processing process on image data output from the first image processing module, and when it is determined that the image processing state is not the normal state, the controller is configured to receive image data about the region required to be output from a buffer storing image data output from the first image processing module of the buffers connected to the plurality of image processing modules, and outputs the image data.

The controller may estimate a workload using the state information of the plurality of image processing modules, and sets a complexity of the image processing process based on the estimated workload.

The display apparatus further comprises: a buffer connected to the plurality of image processing modules and configured to receive image data processed by the plurality of image processing modules, and to store the image data, wherein when image data corresponding to the same region as image data pre-stored in the buffer is input from at least one of the plurality of image processing modules, the controller replaces the image data pre-stored in the buffer, with the image data corresponding to the same region.

The plurality of image processing modules may perform different image processing processes.

In accordance with an example aspect of the present disclosure, a control method of a display apparatus comprises: outputting image data processed by any one image processing module of a plurality of image processing modules, based on state information of the plurality of image processing modules; and displaying the output image data.

The plurality of image processing modules may be connected to a buffer storing image data output from the plurality of image processing modules respectively, and the outputting may further comprises selecting any one buffer of the buffers connected to the plurality of image processing modules based on the state information of the plurality of image processing modules, and outputting image data stored in the selected buffer.

The outputting may further comprise determining whether an image processing state is in a normal state by receiving the state information from the plurality of image processing modules and comparing the received state information, wherein the normal state is a state in which the image data about a region required to be output is output normally.

The plurality of image processing modules may comprise a first image processing module comprising first image processing circuitry configured to perform a first image processing process on image data and a second image processing module comprising second image processing circuitry configured to perform a second image processing process on image data output from the first image processing module and the outputting further comprises when it is determined that the image processing state is not the normal state, receiving image data about the region required to be output from a buffer storing image data output from the first image processing module of the buffers connected to the plurality of image processing modules, and outputting the image data.

The plurality of image processing modules may be connected to a buffer receiving image data processed by the plurality of image processing modules and storing the image data and the outputting further comprises when image data corresponding to the same region as image data pre-stored in the buffer is input from at least one of the plurality of image processing modules, determining whether the image data pre-stored in the buffer is to be replaced with the image data corresponding to the same region based on an image processing level.

BRIEF DESCRIPTION OF THE DRAWINGS

These and/or other aspects, features and attendant advantages of the present disclosure will become apparent and more readily appreciated from the following detailed description, taken in conjunction with the accompanying drawings, in which like reference numerals refer to like elements, and wherein.

DETAILED DESCRIPTION

Reference will now be made in greater detail to various example embodiments of the present disclosure, examples of which are illustrated in the accompanying drawings.

Figure 1:
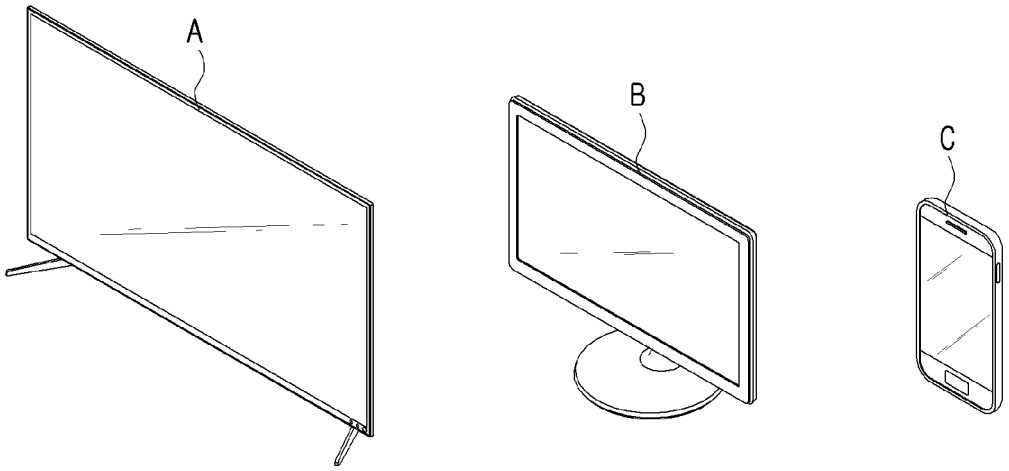
FIG. 1 is diagram illustrating a variety of example display apparatuses in accordance with an example embodiment of the present disclosure.
Figure 2:
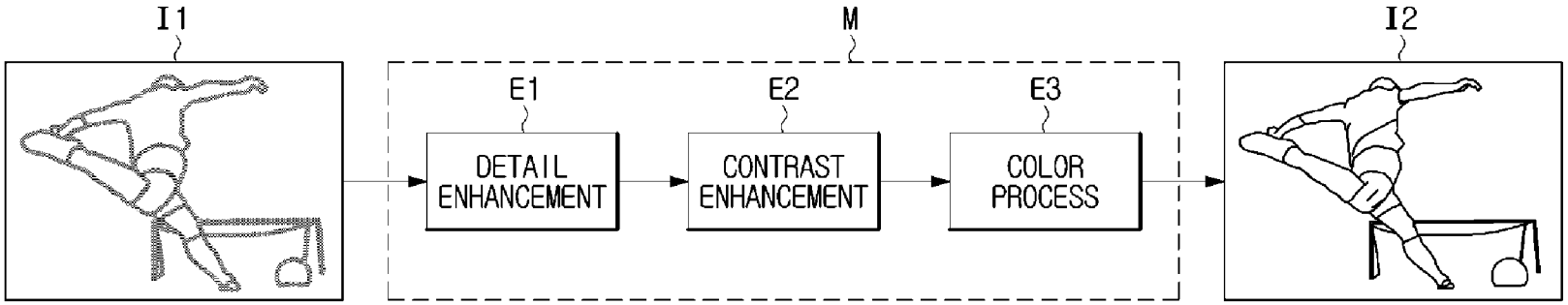
FIG. 2 is a diagram illustrating an example of improving the image quality of image data through an image processing process.

FIG. 1 is diagram illustrating a variety of example display apparatuses in accordance with an example embodiment of the present disclosure, and FIG. 2 is a diagram illustrating an example of improving the image quality of image data through an image processing process. Hereinafter in order to avoid a repeated description, a description thereof will be described together.

A display apparatus may refer, for example, to an apparatus capable of visually displaying image data in various formats by having a display panel. For example, and without limitation the display apparatus may include a variety of apparatus, e.g., a television (TV) A, a monitor B and a smart phone C, or the like, capable of displaying a variety of image data on a display panel.

A display apparatus may include various types of apparatuses including a portable multimedia device, for example, and without limitation, a personal digital assistant (PDA) and a portable multimedia player (PMP), and a portable communication device, a wearable device in glasses type and watch type, or the like. In addition, the display apparatus may include all types of devices in which a processor is embedded to process an image processing and in which a display panel is provided to visually display the image data, and thus there is no limitation in the implementation form.

Since an image processing apparatus is typically embedded in the display apparatus, the display apparatus may perform an image processing process. Referring to FIG. 2, the display apparatus may perform an image processing process (M) through the image processing apparatus to generate second image data (I2) having an improved image quality, based on first image data (I1). The first image data (I1) may represent image data in a state in which the image processing process (M) is not performed, and the second image data (I2) may represent image data in a state in which the image processing process (M) is performed.

When comparing the first image data (I1) with the second image data (I2), it may be confirmed that the image quality of the second image data (I2) is improved with respect to the first image data (I1). The image processing process described hereinafter includes, but is not limited to, converting a format to display an image on a display panel, as well as a pre-processing of the image data, e.g., decoding, and a series of image quality improving process, e.g., noise reduction, contrast enhancement, detail enhancement and color process.

For example, the image processing process (M) may include at least one of the detail enhancement (E1), the contrast enhancement (E2), and the color process (E3). The image processing process (M) is not limited thereto, and thus the image processing process (M) may include a series of processes performed when image data is displayed on a display panel.

As for the image processing process, real-time processing conditions may be required. The image data may be displayed on the display panel in real time. In order to display the image data in real time, the image processing process may be performed in real time.

For example, there is a previously assigned time for the image processing process and thus it may be required that the image processing process is completed within the assigned time. However, when performing the image processing process, it may be difficult to meet the real-time processing conditions since a period of time, which is required to complete the image processing process, varies due to various factors.

When deadline miss is generated since the real-time processing conditions are not met, e.g., the time assigned for the image processing process is expired, visual artifacts may be significantly generated on the image displayed on the display panel.

According to an example embodiment, in order to relieve the above mentioned difficulties, the image processing apparatus may secure the image quality without significant visual artifact although the real-time processing is not allowed. Hereinafter a block diagram of an example image processing apparatus will be described in greater detail.

Figure 3:
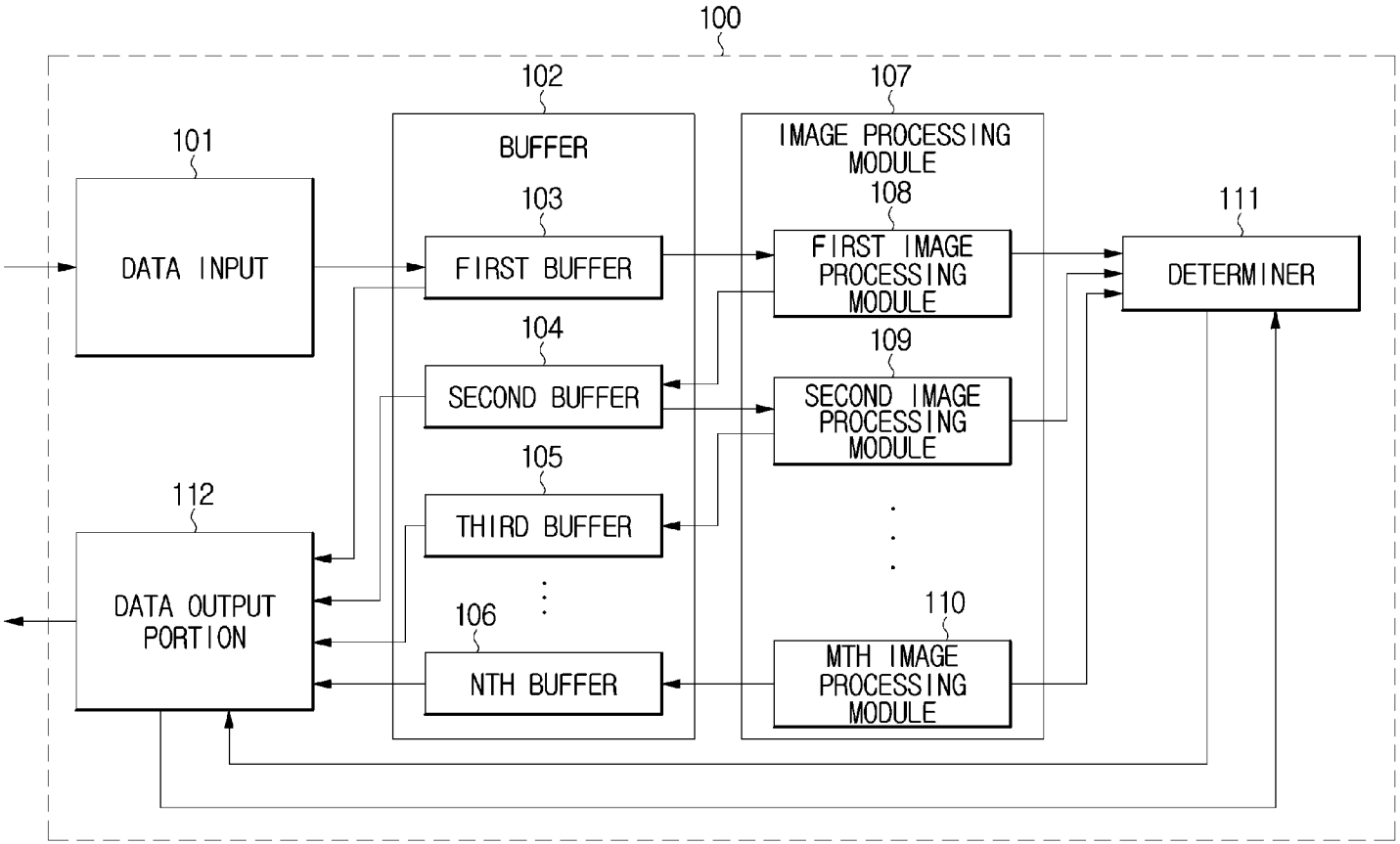
FIG. 3 is a block diagram illustrating an example image processing apparatus in accordance with an example embodiment.
Figure 4:
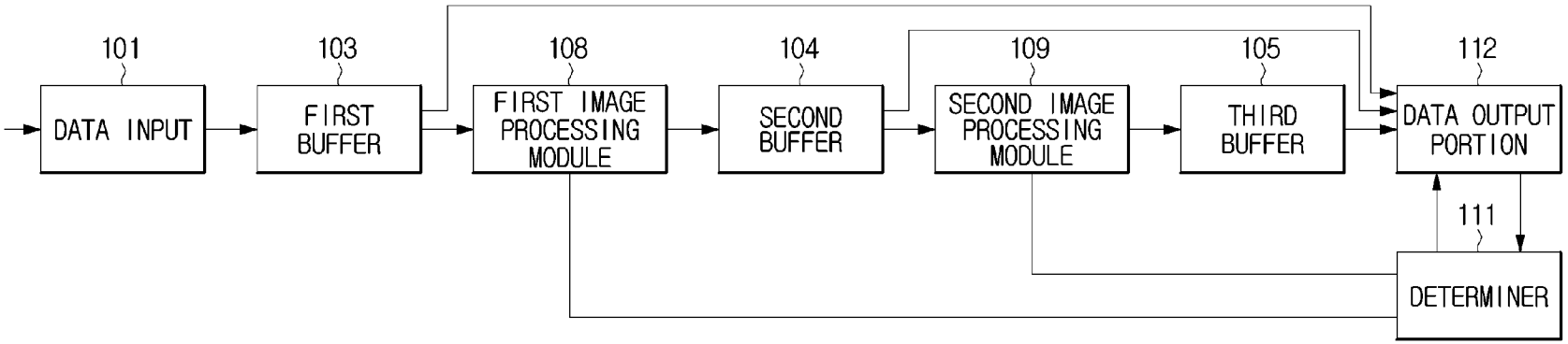
FIG. 4 is a block diagram illustrating an example image processing apparatus based on an operation flow in accordance with an example embodiment.
Figure 5:
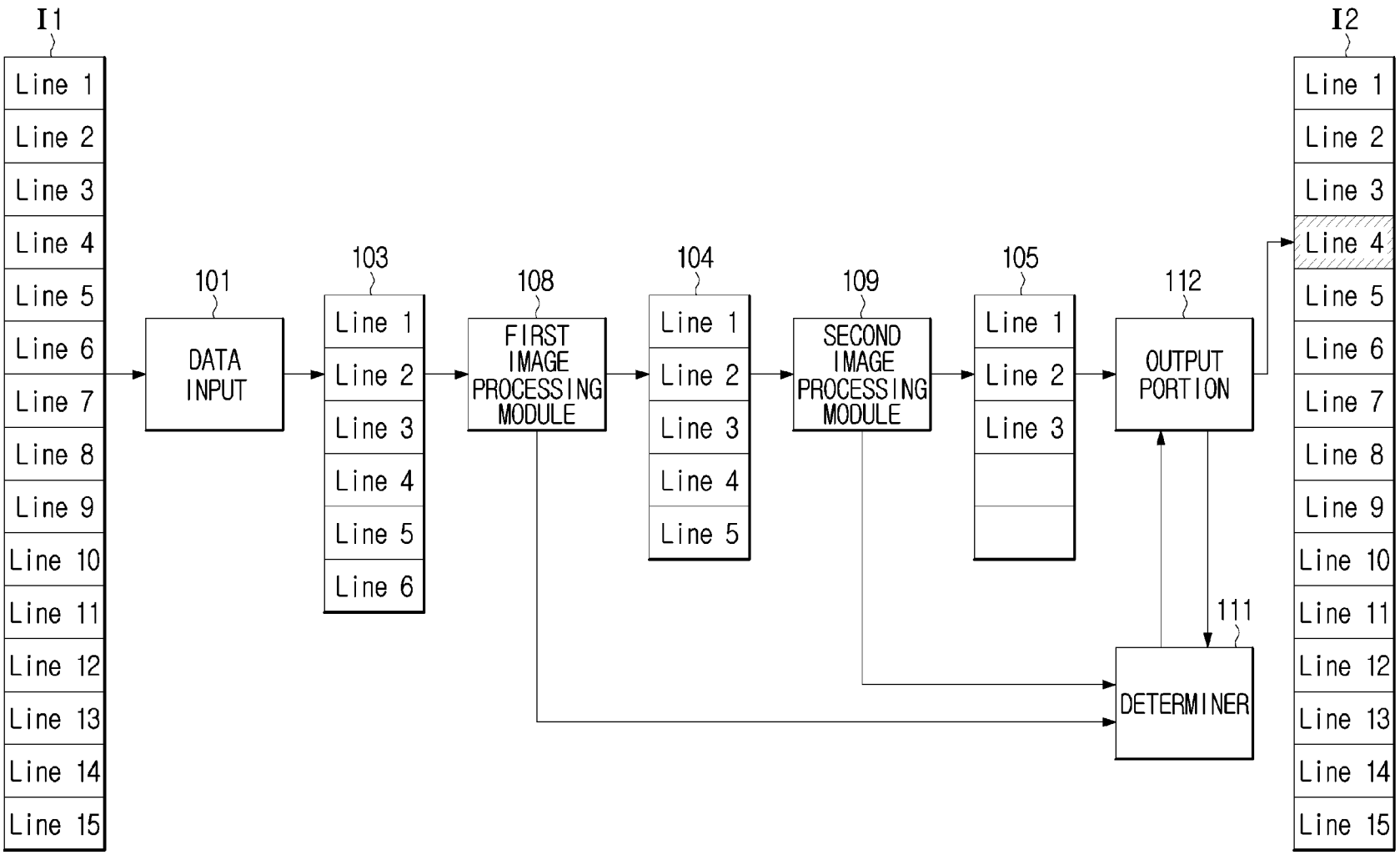
FIG. 5 is a diagram illustrating an example operation of the image processing apparatus performing an image processing by receiving image data in an order of line according to an example embodiment.
Figure 6:
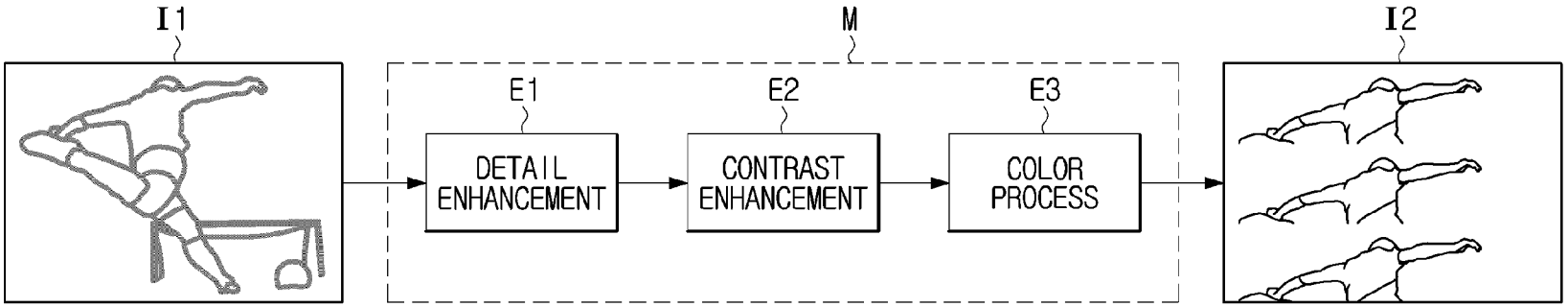
FIG. 6 is a diagram illustrating example problems generated when a real-time condition is not met in accordance with an example embodiment.
Figure 7A:
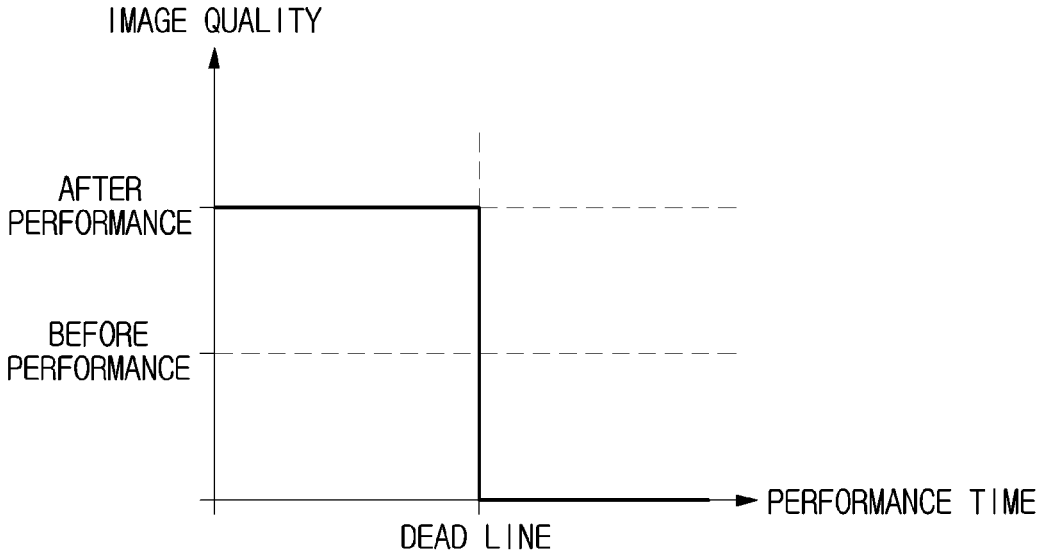
FIGS. 7A, 7B and 7C are graphs illustrating example image quality improvement of the image processing apparatus in accordance with an example embodiment.
Figure 7B:
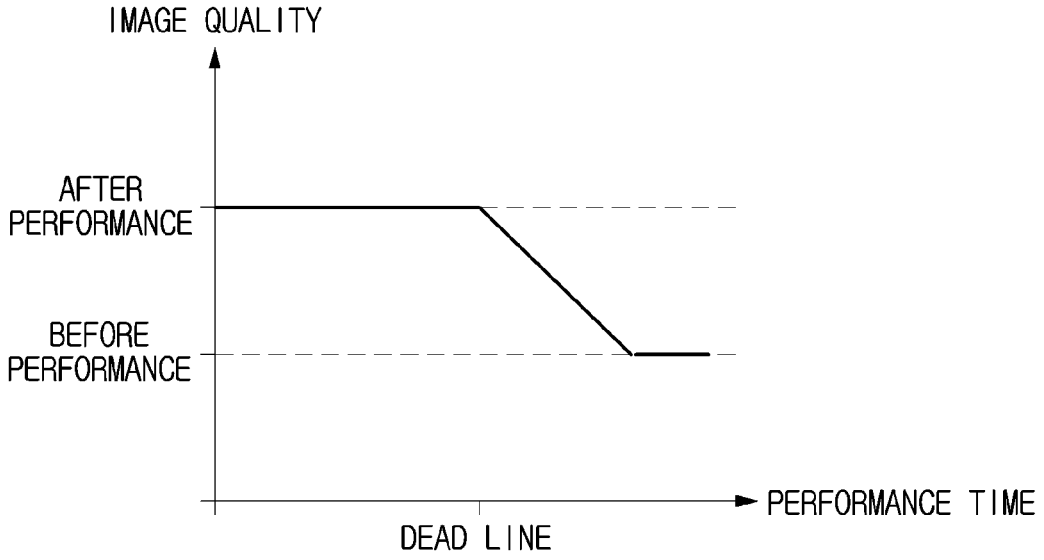
Figure 7C:
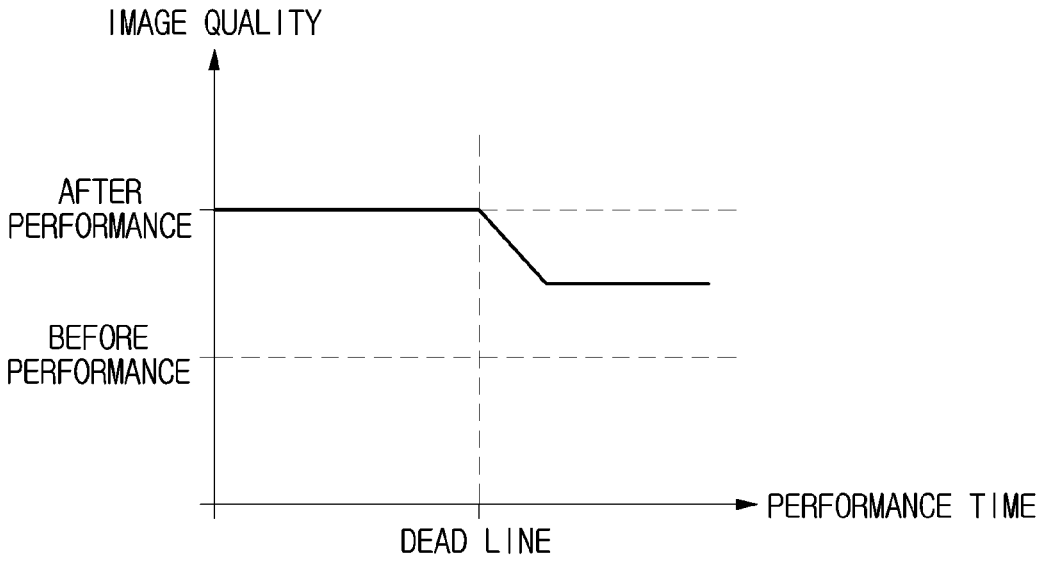
Figure 8:
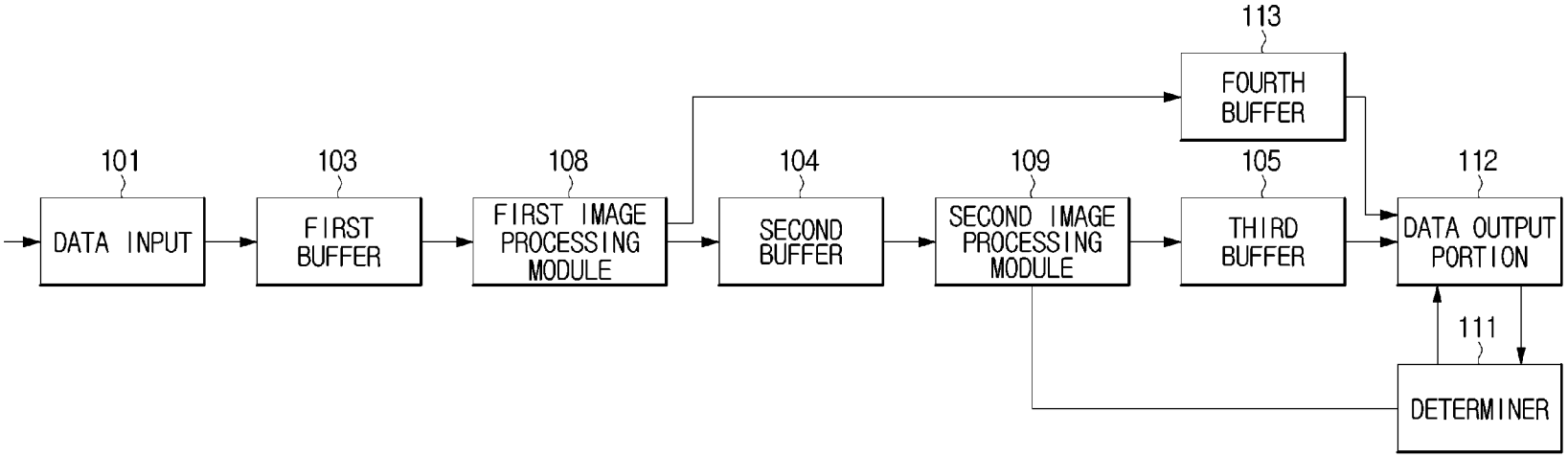
FIGS. 8 and 9 are block diagrams illustrating an example image processing apparatus in which an additional buffer is provided, in accordance with various example embodiments.
Figure 9:
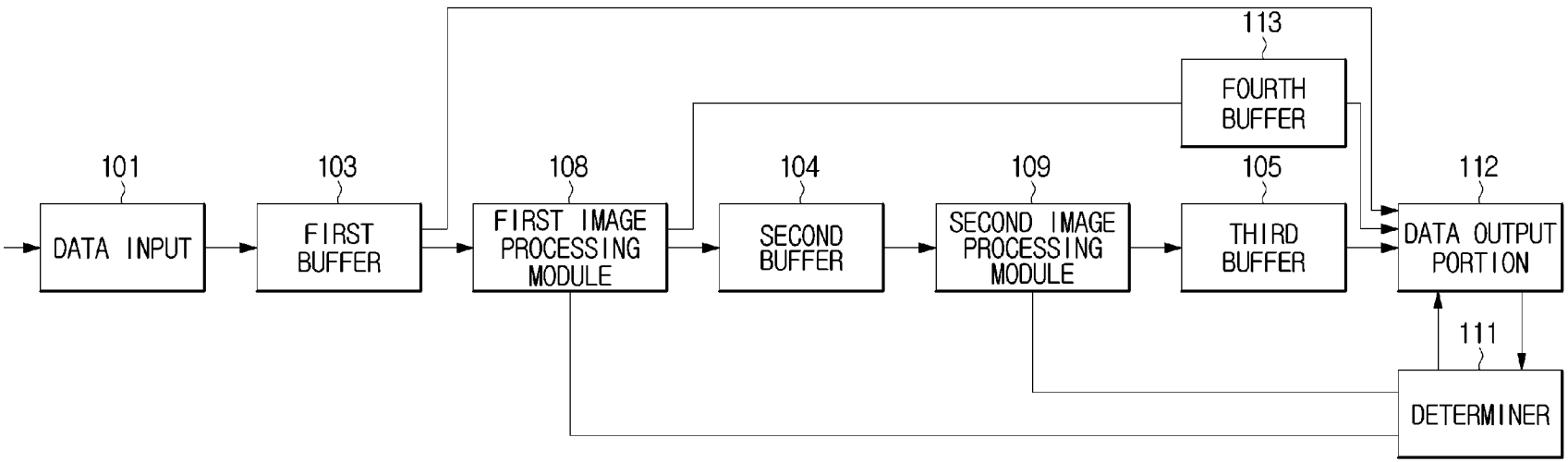
Figure 10:
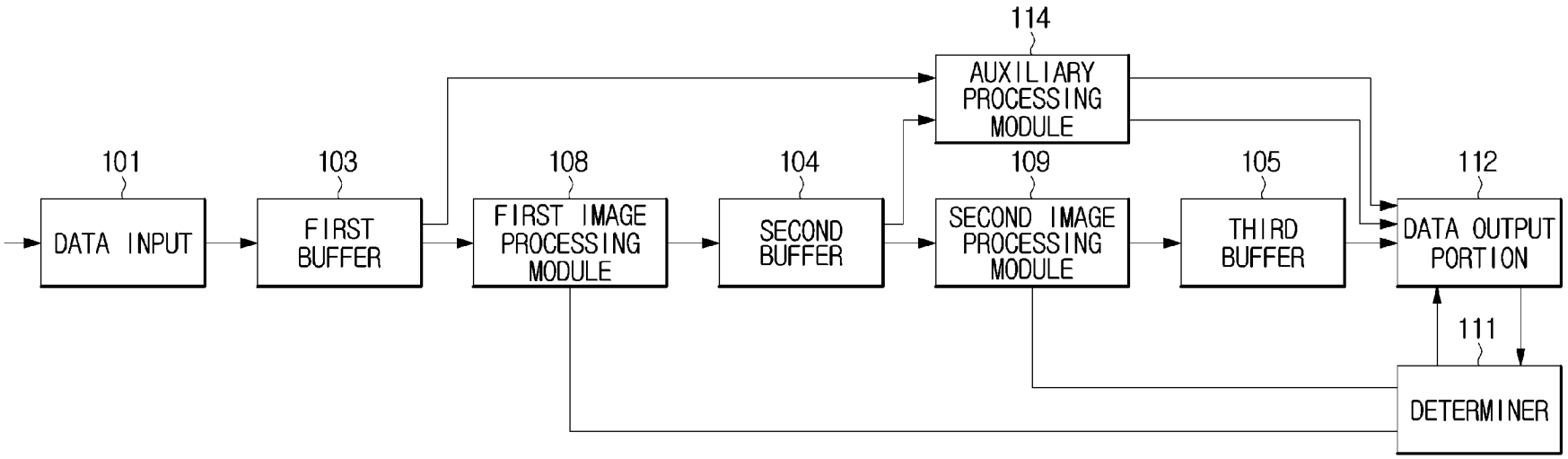
FIG. 10 is a block diagram illustrating an example image processing apparatus in which an auxiliary processing module is provided, in accordance with an example embodiment.
Figure 11A:
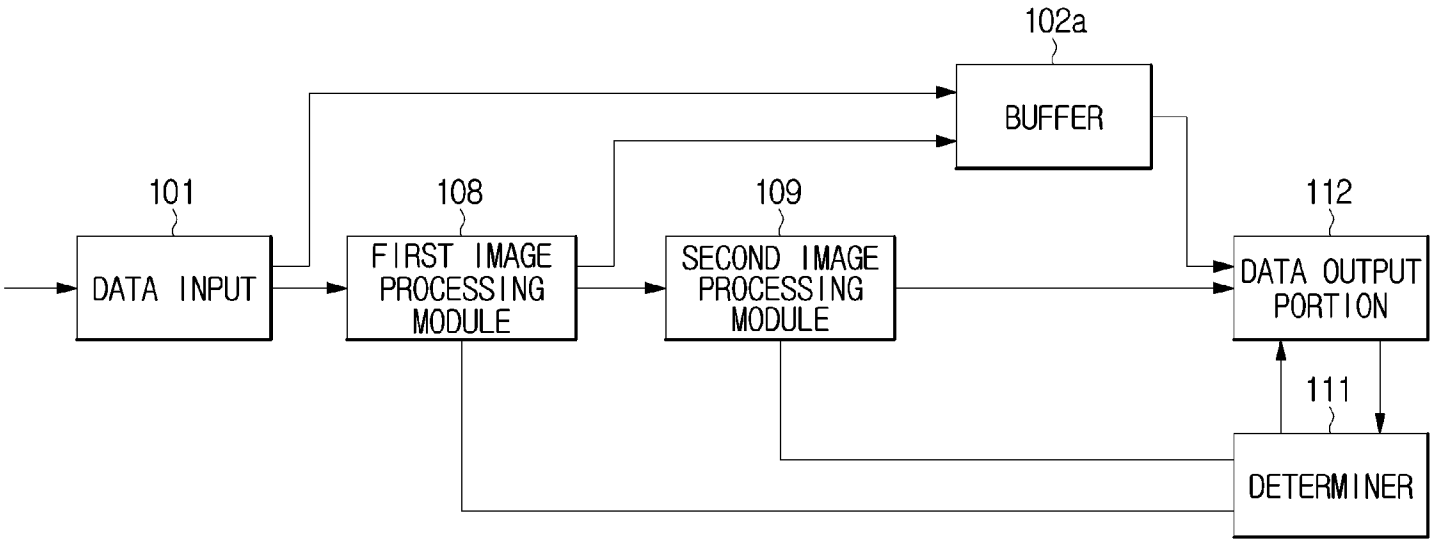
FIGS. 11A and 11B are block diagrams illustrating an example image processing apparatus in which a single buffer is provided, in accordance with various example embodiments.
Figure 11B:
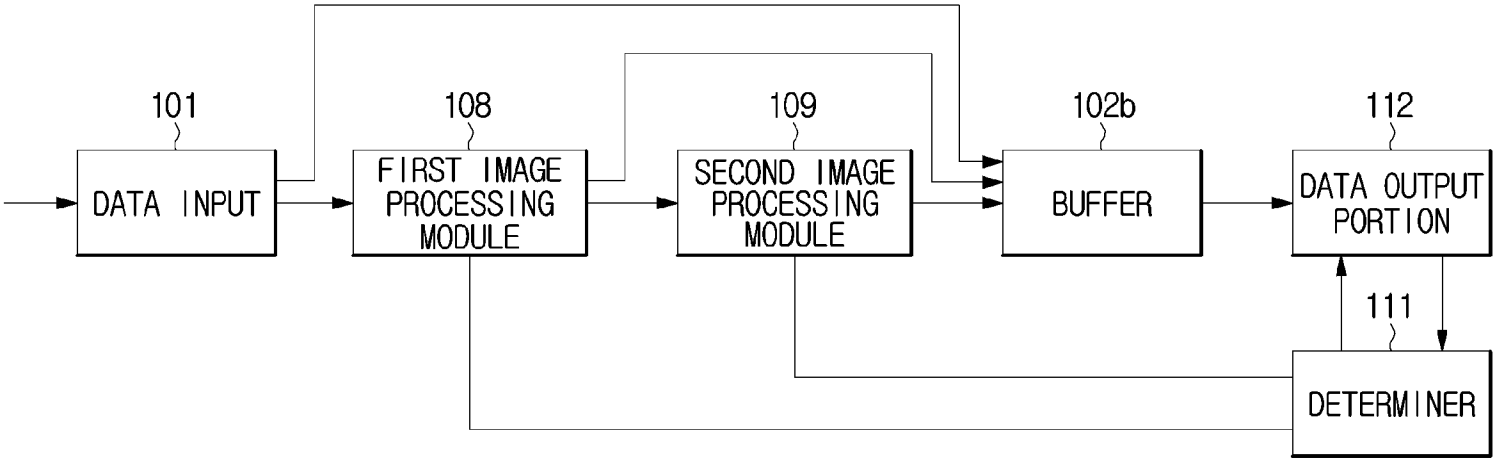

FIG. 3 is a block diagram illustrating an example image processing apparatus in accordance with an example embodiment, and FIG. 4 is a block diagram illustrating an example image processing apparatus based on an operation flow in accordance with an example embodiment. FIG. 5 is a diagram illustrating an example operation of the image processing apparatus performing an image processing by receiving image data in an order of line, and FIG. 6 is a diagram illustrating example problems generated when a real-time condition is not met in accordance with an example embodiment. FIGS. 7A, 7B and 7C are graphs illustrating example image quality improvement of the image processing apparatus in accordance with an example embodiment, and FIGS. 8 and 9 are block diagrams illustrating an example image processing apparatus in which an additional buffer is provided, in accordance with various example embodiments. FIG. 10 is a block diagram illustrating an example image processing apparatus in which an auxiliary processing module is provided, in accordance with an example embodiment, and FIGS. 11A and 11B are block diagrams illustrating an example image processing apparatus in which a single buffer is provided, in accordance with various example embodiments. Hereinafter in order to avoid a repeated description, a description thereof will be described together Referring to FIG. 3, the image processing apparatus 100 may include a data input (e.g., including input circuitry) 101, a buffer 102, an image processing module (e.g., including image processing circuitry) 107, a determiner (e.g., including processing circuitry) 111 and a data output portion (e.g., including data output circuitry) 112. At least one of the data input 101, the buffer 102, the image processing module 107, the determiner 111 and the data output portion 112 may be integrated in a system on chip (SOC) provided in the image processing apparatus 100. However, the number of the system on chip (SOC) provided in the image processing apparatus 100 is not limited to one, and thus it is not limited that those is integrated in a single system on chip (SOC).

In the following description, terms such as "unit", "part" and "module" may refer, for example, to a unit for processing at least one function or operation. For example, "unit", "part" and "module" may represent software, hardware, or any combination thereof, such as, for example, and without limitation, a dedicated processor, a CPU, a Field Programmable Gate Array (FPGA), an Application Specific Integrated Circuit (ASIC), or the like. However, the term "unit", "part" and "module" are not limited to software or hardware. Further, "unit", "part" and "module" may be stored in an accessible storage module, or "unit", "part" and "module" may be a component performed by one or more processors.

The data input 101 may include various circuitry and receive an input of image data. For example, the data input 101 may receive an input of image data via an input terminal at a predetermined timing.

The data input 101 may convert a format of image data received through the input terminal. According to an embodiment, the data input 101 may perform a decoding process to allow the image processing module 107 to perform an image processing.

The input terminal may be connected to a variety of external image sources or a memory in the display apparatus 1 so that the data input 118 may receive image data from the external image sources or image data stored itself in the memory in the display apparatus 1. The external image sources may include an external memory and an external server. The external image sources may be directly connected to an image processor (e.g., including processing circuitry) 150*a* a content receiver (e.g., including content receiving circuitry) 120, a communicator (e.g., including communication circuitry) 140 or connected to a controller (e.g., including processing circuitry) 170 that is contained in a display apparatus 1 (refer to FIG. 13A) described later.

The data input 101 may store image data whose format is converted, in a first buffer 103. A first image processing module 108 may perform an image processing process by receiving image data stored in the first buffer 103. The image data stored in the first buffer 103 may be sequentially input to the first image processing module 108 and go through the image processing process. Accordingly, the image data that has gone through the image processing process may be sequentially output and then stored in the second buffer 104.

In relation to the data input 101, the first buffer 103 may be operated as an output buffer storing image data that is output from the data input 101, and in relation to the first image processing module 108, the first buffer 103 may be operated as an input buffer storing image data that is input to the first image processing module 108. A detailed description of the buffer 102 and the image processing module 107 will be described later.

The data input 101 may receive an input of image data according to a predetermined order. For example, the data input 101 may receive an input of image data in an order of a line.

The image data may be displayed on a plurality of pixels forming a display panel, and the plurality of pixels may be divided by a horizontal line or vertical line. For example, first image data (I1) as illustrated in FIG. 2 may be formed by 15 lines as illustrated in FIG. 5, and image data in each line may be sequentially input to the data input 101. In addition, the data input 101 may output the image data in an order in which the image data is input, and then store the image data in the first buffer 103. The first image processing module 108 may sequentially perform an image processing process on the image data stored in the first buffer 103.

For example, the data input 101 may receive sequentially image data of from a first line to a fifteenth line. The data input 101 may perform a series processing such as converting format, on the image data of the first line to the image data of the fifteenth line. The data input 101 may output the image data of the first line and store in the first buffer 103 and store the image data of the fifteenth line, at the last.

The buffer 102 may be provided in the image processing apparatus 100. Referring to FIG. 3, the buffer 102 may include at least one of the first buffer 103, the second buffer 104, the third buffer 105 and a $n^{th}$ buffer 106 ($N \geq 4$). In a relation to at least one of the image processing module 107 and the data output portion 112, the first buffer 103, the second buffer 104, the third buffer 105 and the $n^{th}$ buffer 106 ($N \geq 4$) may be operated as an output buffer while being operated as an input buffer. A detail description thereof will be described later.

Hereinafter for convenience of description, the buffer 102 comprising the first buffer 103, the second buffer 104, and the third buffer 105 will be described as an example. In addition, if there is no need to distinguish the first buffer 103, the second buffer 104, and the third buffer 105, the first buffer 103, the second buffer 104, and the third buffer 105 will be referred to as the buffer 102.

In the buffer 102, a memory may be provided to store a variety of data. For example, since the memory is provided in the buffer 102, image processing processed-image data may be stored. In this time, the storage capacity of the first buffer 103, the second buffer 104, and the third buffer 105 may be predetermined, respectively. For example, the storage capacity of the first buffer 103, the second buffer 104, and the third buffer 105 may be set to be the same or different from each other. A memory address may be pre-assigned to a memory of the first buffer 103, the second buffer 104, and the third buffer 105.

Information related to the first buffer 103, the second buffer 104, and the third buffer 105 may be recorded on a register of the image processing apparatus 100. Accordingly, the data output portion 112 may selectively read image data based on the information recorded on the register.

Alternatively, the information related to the first buffer 103, the second buffer 104, and the third buffer 105 may be stored in the data output portion 112 in advance and thus the data output portion 112 may selectively read image data based on the pre-stored information. According to an embodiment, the data output portion 112 may select desired image data using the memory address and output the selected image data to the output terminal. A detailed description of the data output portion 112 will be described later.

The buffer 102 may be implemented as a circular buffer. Accordingly, when the storage capacity of the buffer 102 is full, the oldest image data among the stored image data may be deleted and image data which is newly input may be stored.

For example, when image data in three lines can be stored in the first buffer 103, image data of the first line may be stored in a memory address '0x000000', image data of the second line may be stored in a memory address '0x000010', and image data of the third line may be stored in a memory address '0x01000'. In this time, when the image data of a fourth line is output from the data input 101, the image data of the first line in the memory address '0x000000' may be deleted and the image data of the fourth line may be stored in the memory address '0x000000'.

As mentioned above, in the relation to the data input 101, the first buffer 103 may be operated as the output buffer and in the relation to the first image processing module 108, the first buffer 103 may be operated as the input buffer.

In the relation to the first image processing module 108, the second buffer 104 may be operated as the output buffer receiving image data which is gone through the first image processing process, from the first image processing module 108. In the relation to the second image processing module 109, the second buffer 104 may be operated as the input buffer storing image data input to the second image processing module 109.

In the relation to the second image processing module 109, the third buffer 105 may be operated as the output buffer receiving image data, which is gone through a second image processing process and outputs from the second image processing module 109, and storing the image data. In the relation to the data output portion 112, the third buffer 105 may be operated as the input buffer storing data which is output to the output terminal by the data output portion 112.

The image processing module 107 may be provided in the image processing apparatus 100. The image processing module 107 may include at least one of the first imaging process module 108, the second imaging process module 109, and a $M^{th}$ 110 ($M \geq 3$), but the number of image processing module is not limited thereto. Hereinafter for convenience of description, the image processing module 107 composed of the first image processing module 108, and the second image processing module 109 will be described as an example.

Hereinafter an image processing process performed by the first image processing module 108 may be referred to as a first image processing process and image data that is gone through a first image processing may be referred to as 'first image data'. An image processing process performed by the second image processing module 109 may be referred to as a second image processing process and image data that is gone through a second image processing may be referred to as 'second image data'. In addition, if there is no need to distinguish the first image processing process, and the second image processing process, the first image processing process, and the second image processing process will be referred to as the image processing process.

The first image processing module 108 may perform the first image processing process to output the first image data and the second image processing module 109 may perform the second image processing process on the first image data to output the second image data. Therefore, the image quality may be gradually improved. That is, as image data sequentially passes a plurality of image processing process, the image quality of the image data may be gradually improved.

However, since the image data is displayed on the display panel in real time, it may be required that the image processing process may be performed in a short period of time, and the data output portion 112 may output image data according to a predetermined timing.

According to the conventional method, although image data of $X^{th}$ line is not output from the image processing module when an image processing apparatus should output image data of $x(x \geq 1)^{th}$, the image processing apparatus continuously output the image data stored in a final output buffer, e.g., the third buffer 105. Accordingly, an image related to the same region on the display panel may be repeatedly displayed and thus significant visual artifacts may occur, as illustrated in FIG. 6.

On the other hand, although image data of $X^{th}$ line is not output from the second image processing module 109 when an image processing apparatus should output image data of $x(x \geq 1)^{th}$, the data output portion 112 according to an embodiment may output the image data of $X^{th}$ line stored in a buffer, e.g., the second buffer 104, in which the first image processing processed data is stored, thereby preventing and/or reducing visual artifacts. A detailed description thereof will be described later.

The image processing module 107 may perform the image processing process converting a format of image data to fit to the format required by the output terminal. In addition, the image processing module 107 may perform the image processing process to improve the image quality.

The image processing module 107 may perform the image processing process on image data related to entire region. Also, the image processing module 107 may perform the image processing process for improving the image quality related to a specific region. In this time, the specific region may correspond to an interest region required to improve the image quality, and the controller 170 may perform only the format conversion about image data in regions other than the specific region.

When the first image processing process of the first image processing module 108 is completed, the second image processing module 109 may receive the first image data stored in the second buffer 104 and then perform the second image processing process. As the size of the interest region requiring the improvement of the image quality is increased, calculation requirement may be increased and thus the risk of the delay may be increased. Therefore, there is a high risk of violating the real-time processing conditions. Therefore, when it is required to display an image having the high image quality, there may be a high risk of violating the real-time processing conditions and there may be a high risk of generation visual artifacts. Hereinafter a detail description of the determiner 111 configured to determine whether to meet real time conditions will be described later.

According to an embodiment, the image processing apparatus 100 may be provided with the determiner 111.

The determiner 111 may include various circuitry and determine whether a state of image processing is normal or not by receiving state information of components in the image processing apparatus 100. State information may be configured to detect a state of components in the image processing apparatus 100, and include storage information of the buffer 102, information related to image data input to the image processing module 107, information related to image data output from the image processing module 107, an image processing result, information related to a progress status of the image processing module 107, and information related to the processing speed.

For example, the data input 101, the first image processing module 108, and the second image processing module 109, each may record the state information in the register of the image processing apparatus 100. The determiner 111 may receive the state information and determine the state of the image processing by comparing the state information among each component.

For example, when the determiner 111 is connected to the image processing module 107, the determiner 111 may receive the state information of the image processing module 107 and then determine whether the state of the image processing is normal, by comparing the state information. In other words, the determiner 111 may determine whether an image processing result meets real time processing conditions.

The determiner 111 may continue to update the state information. The determiner 111 may compare the image processing results by a predetermined period of time so as to determine whether the state of image processing is normal, e.g., whether the state of image processing meets the real-time processing conditions.

For example, based on the state information, the determiner 111 may detect that the first image processing module 108 and the second image processing module 109 perform the image processing process about image data of which line, respectively, image data of which line is in an input queue, and detect that up to which image date of line is output. In addition, the determiner 111 may compare the detected result with number of line in which image data required to be output via the data output portion 112 is placed, to determine whether the state of image processing meets the real-time conditions.

According to an embodiment, when image data of $y^{th}$ is required to be output in a state in which image data of $y^{th}$ is stored in the third buffer 105, the determiner 111 may determine that the state of the image processing meets the real-time conditions, that is, the state of the image processing is in a normal state.

According to another embodiment, when image data of $z^{th}$ is required to be output in a state in which image data of up to $z\text{-}1^{th}$ is stored in the third buffer 105, the determiner 111 may determine that the state of the image processing is not in the normal state since the state of the image processing does not meet conditions. In this time, the determiner 111 may determine whether image data of $z^{th}$ is stored in the first buffer 103 and the second buffer 104. The determiner 111 may transmit a determination result to the data output portion 112. Based on the determination result, the data output portion 112 may receive the image data of $z^{th}$ from any one of the first buffer 103 and the second buffer 104 and then output the image data. Hereinafter a description of the data output portion 112 will be described.

The data output portion 112 may select image data stored in at least one of plurality of buffers based on the determination result, receive the selected image data and output the selected image data. For example, the data output portion 112 may be connected to the first buffer 103, the second buffer 104, and the third buffer 105 as illustrated in FIGS. 3 and 4. Accordingly, the data output portion 112 may read image data stored in at least one of the first buffer 103, the second buffer 104, and the third buffer 105 and output the image data to the output terminal.

The data output portion 112 may be connected to other image processing apparatus, the controller 170 (refer to FIG. 13A) of the display apparatus 1 (refer to FIG. 13A), or the display panel 20 (refer to FIG. 13A) described in later. Therefore, there is no limitation in the implementation of the data output portion 112.

Referring to FIG. 5, when image data of fourth line is required to be output, the image data of fourth line may be not stored in the third buffer 105. The determiner 111 may determine that the image data of fourth line is stored in the first buffer 103 and the second buffer 104, based on the state information. The determiner 111 may transmit the determination information such as information related to the violation in the real time processing conditions, and information related to image data stored in the buffers 102, 104 and 105, to the data output portion 112. The data output portion 112 may receive the image data of fourth line stored in the second buffer 104, which has an improved image quality than the image data of fourth line stored in the first buffer 103, and output the image data of fourth line to the output terminal.

According to an embodiment, the data output portion 112 may select image data having the most improved image quality among image data in the same line, based on the determination result related to the state of the image processing.

For example, according to an embodiment, when image data of $u^{th}$ is stored in the first buffer 103, the second buffer 104 and the third buffer 105 within a predetermined assigned period of time, the data output portion 112 may select the image data of $u^{th}$ stored in the third buffer 105 and output the image data. For another example, when image data of $u^{th}$ is stored in the first buffer 103 and the second buffer 104 within a predetermined assigned period of time, the data output portion 112 may select the image data of $u^{th}$ stored in the second buffer 104 and output the image data.

For another example, when image data of $u^{th}$ is stored only in the first buffer 103 within a predetermined assigned period of time, the data output portion 112 may select the image data of $u^{th}$ stored in the first buffer 103 and output the image data.

That is, according to an embodiment, since the image processing apparatus 100 is provided with the determiner 111 connected to at least one of the data input 101 and the first and second image processing module 108 and 109, the image processing apparatus 100 may continue to receive the state information of the data input 101 and the first and second image processing module 108 and 109, and determine the state of the image processing. According to an embodiment, since the image processing apparatus 100 is provided with the data output portion 112 connected to the first, second, and third buffer 103, 104 and 105, the image processing apparatus 100 may select image data stored in any one of the first, second, and third buffer 103, 104 and 105 and output the image data, based the determination result. Accordingly, according to an embodiment, the image processing apparatus 100 meets the real time processing conditions while preventing visual artifacts.

FIG. 7A is a graph illustrating an example change in the image quality when visual artifacts occur. Referring to FIG. 7A, when visual artifacts occur, the image quality may be dropped rather than performing the image processing process.

According to an embodiment, the data output portion 112 may prevent and/or reduce the generation of the visual artifact by outputting image data in the first buffer 103 although the state of the image processing does not meet the real time processing condition, as illustrated in FIG. 7B. According to an embodiment, the data output portion 112 may provide image data without breaking by outputting image data in the second buffer 104 although the state of the image processing does not meet the real time processing condition, as illustrated in FIG. 7C.

The determiner 111 or the data output portion 112 may collect the state information and the determination information related to the state of the processing and store the state information and the determination information in a database. The database may be implemented as a memory. The database may be provided in the image processing apparatus 100 or alternatively provided in an external server via a communication network.

For example, a log file in which the image processing history information is recorded may be stored in the database. In the log file, various image processing history information such as the state information, e.g., the storage rate of the buffer 102, the process status and the processing speed of the image processing module 107, and the determination information of the determiner 111 may be stored.

Accordingly, a processor of the image processing apparatus 100 may analyze data stored in the database and estimate a workload according to the input image data. The processor of the image processing apparatus 100 may set a complexity of the image processing process based on the estimation result. For example, the processor of the image processing apparatus 100 may set the complexity of the image processing process to be lower as the estimated workload is high and the capacity of the image processing module 107 is low.

For example, according to an embodiment, the image processing apparatus 100 may prevent the sharp drop in the image quality of the image data as well as managing the resource in the image processing apparatus 100, thereby stably reproducing the image.

The above mentioned workload estimation and set of complexity may be performed by the determiner 111 or the data output portion 112 as well as the processor, and thus there is no limitation in the implementation of thereof.

According to an embodiment, the implementation of the image processing apparatus 100 is not limited to the above mentioned example.

For example, according to an embodiment, the image processing apparatus 100 may be provided with an additional auxiliary buffer other than the final output buffer, e.g., the third buffer 105, and the additional auxiliary buffer may be used as an alternative of the final output buffer.

According to an embodiment, the image processing apparatus 100 may be provided with a fourth buffer 113 additionally provided and used as an alternative of the first buffer 103, as illustrated in FIG. 8.

Referring to FIG. 8, the fourth buffer 113 may be connected to between the first image processing module 108 and the data output portion 112. The first image processing module 108 may output image data and store the image data in the second buffer 104 and the fourth buffer 113, respectively.

When the processing conditions are not met, there may be a high possibility in which image data required to be output is present in the second buffer 104 before performing the second image processing process. When the same image data is stored in the second buffer 104 and the first buffer 103, image data stored in the second buffer 104 has a higher image quality than the image data stored in the first buffer 103. Therefore, according to an embodiment, the first image processing module 108 may simultaneously store the image data to be output in the buffer 102 and the second buffer 104 and thus when there is no image data required to be output in the fourth buffer 113, the data output portion 112 may output the image data stored in the third buffer 105.

The image data stored in the second buffer 104 may be only used to be input to the second image processing module 109 and the image data stored in the first buffer 103 may be only used to be input to the first image processing module 108. Therefore, it is not required that the first buffer 103 and the second buffer 104 are connected to the data output portion 112, and it is not required that the determiner 111 is connected to the first image processing module 108. Accordingly, according to an embodiment, the determiner 111 may derive a determination result with a small amount of calculation and thus the image processing apparatus 100 may have a simple configuration.

As illustrated in FIG. 9, the data output portion 112 may be connected to the first buffer 103 as well as the third buffer 105 and the fourth buffer 113. Accordingly, the data output portion 112 may select image data from any one of the third buffer 105, the fourth buffer 113 and the first buffer 103 and output the image data, and the implementation is not limited thereto.

For example, the image processing apparatus 100 as illustrated in FIG. 8 may use the fourth buffer 113 as the alternative of the third buffer 105, and the image processing apparatus 100 as illustrated in FIG. 9 may use the first buffer 103 and the fourth buffer 113 together as the alternative of the third buffer 105.

Referring to FIG. 10, the image processing apparatus 100 may further include an auxiliary processing module 114.

The image data stored in the first buffer 103 and the second buffer 104 may not fit a format required by the output terminal. For example, the image data stored in the first buffer 103 and the second buffer 104 may be structured in a color space format that is different from a color space format required by the output terminal, and formed in a resolution that is different from a resolution required by the output terminal.

When outputting image data stored in at least one of the first buffer 103 and the second buffer 104, the auxiliary processing module 114 may read image data to be output and then perform an auxiliary processing process configured to convert a format required by the output terminal. For example, the auxiliary processing module 114 may perform a process of converting the space color or converting the resolution, e.g., up/down scaling.

The operation performed by the auxiliary processing module 114 may be performed by the data output portion 112 and the auxiliary processing module 114 is not limited to being additionally provided, as illustrated in FIG. 10.

According to an embodiment, the implementation of the image processing apparatus 100 is not limited to include the plurality of buffers. For example, a single buffer 102*a* may be provided in the image processing apparatus 100, as illustrated in FIG. 11A.

The buffer 102*a* may be connected to the data input 101, and the first image processing module 108. The buffer 102*a* may receive image data from the first image processing module 108 and store the image data.

Image data about the same region may be input from the data input 101 and the first image processing module 108 to the buffer 102*a*. In the buffer 102*a*, the stored image data may be replaced or changed according to the image processing level, i.e., a degree of the image quality improvement.

For example, when image data of $f^{th}$ line input from the data input 101 is pre-stored in the buffer 102*a*, the image data of $f^{th}$ line processed by the first image processing module 108 may be input to the buffer 102*a*. In this time, the image data of $f^{th}$ line input from the data input 101 may be deleted in the buffer 102*a* and the image data of $f^{th}$ line processed by the first image processing module 108 may be stored in the buffer 102*a*. Accordingly, according to whether the image data of $f^{th}$ line is allowed to be output from the second image processing module 109 when the image data of $f^{th}$ line is required to be output, the data output portion 112 may selectively receive the image data from any one of the second image processing module 109 or the buffer 102*a* and output the image data.

As illustrated in FIG. 11B, the image processing apparatus 100 may be provided with a single buffer 102*b* connected to the data input 101, the first image processing module 108 and the second image processing module 109.

The buffer 102*b* may store image data output from the data input 101, the first image processing module 108, and the second image processing module 109 and store the image data. In this time, image data about the same region may be input from the data input 101 and the first image processing module 108 to the buffer 102*b*. In the buffer 102*b*, the stored image data may be replaced according to the image processing level.

For example, when image data of $g^{th}$ line input from the first image processing module 108 is pre-stored in the buffer 102*b*, image data of $g^{th}$ line processed by the second image processing module 109 may be input to the buffer 102*b*. In this time, the image data of $g^{th}$ line input from the first image processing module 108 may be deleted in the buffer 102*b* and the image data of $g^{th}$ line processed by the second image processing module 109 may be stored in the buffer 102*b*. That is, all image data connected to the buffer 102*b* may be not stored but image data stored in the buffer 102*b* may be replaced by the image processing level. Accordingly, according to an embodiment, the image processing apparatus 100 may efficiently control the workload of the buffer 102*b* while coping with a timing for quick output. Whether to replace the stored image data may be determined by the data output portion 112 or the determiner 111, or alternatively whether to replace the stored image data may be determined by the buffer 102*b* itself.

Figure 12:
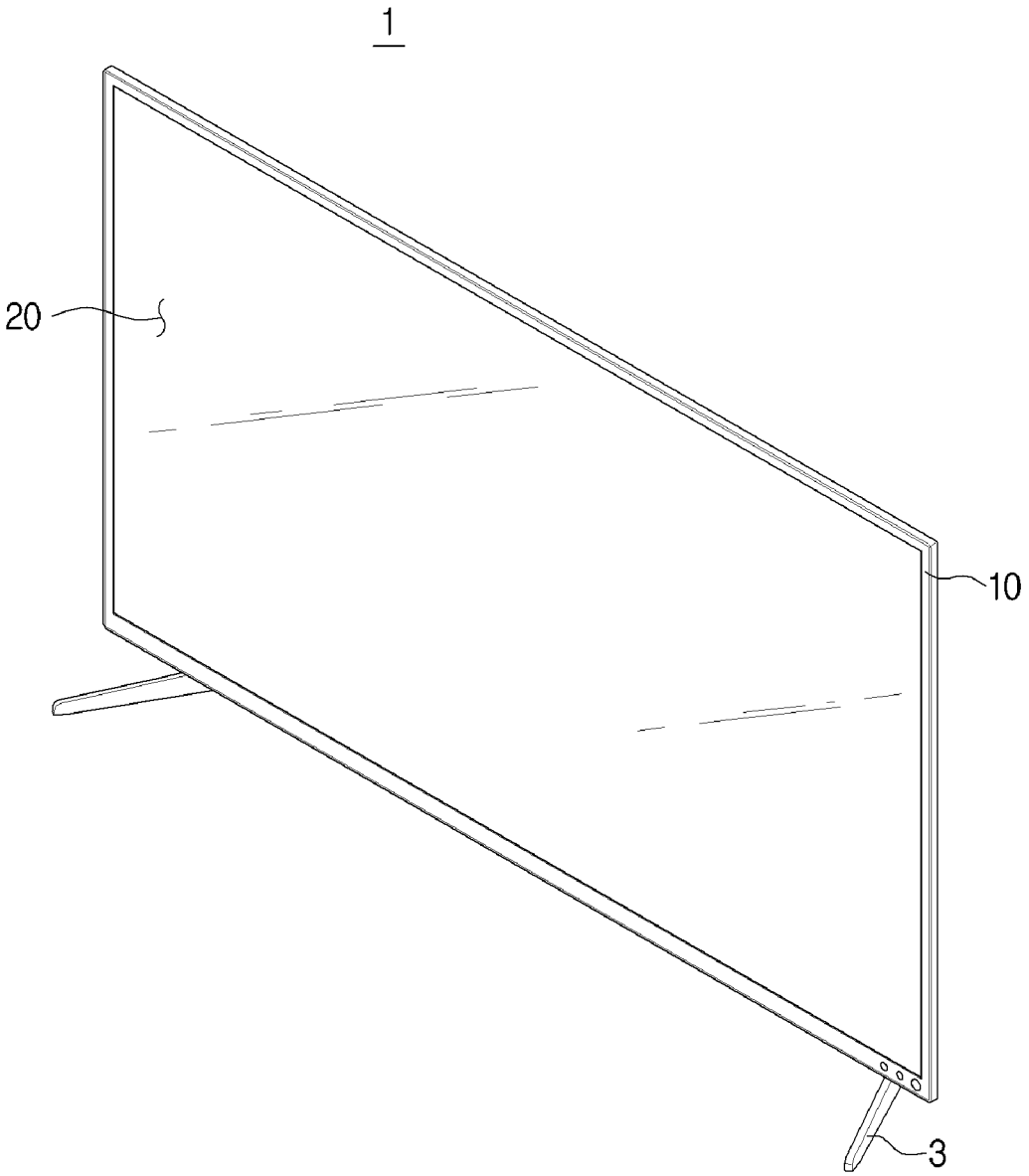
FIG. 12 is a diagram illustrating an example appearance of the display apparatus in accordance with an example embodiment of the present disclosure.

Hereinafter a display apparatus as illustrated in FIG. 12 will be described as an example of the display apparatus but embodiment described later is not limited thereto. Therefore, the embodiment described later will be applied to any kind of display apparatus regardless of the shape thereof as long as capable of visually providing a variety of images to a user by having a display panel.

Figure 13A:
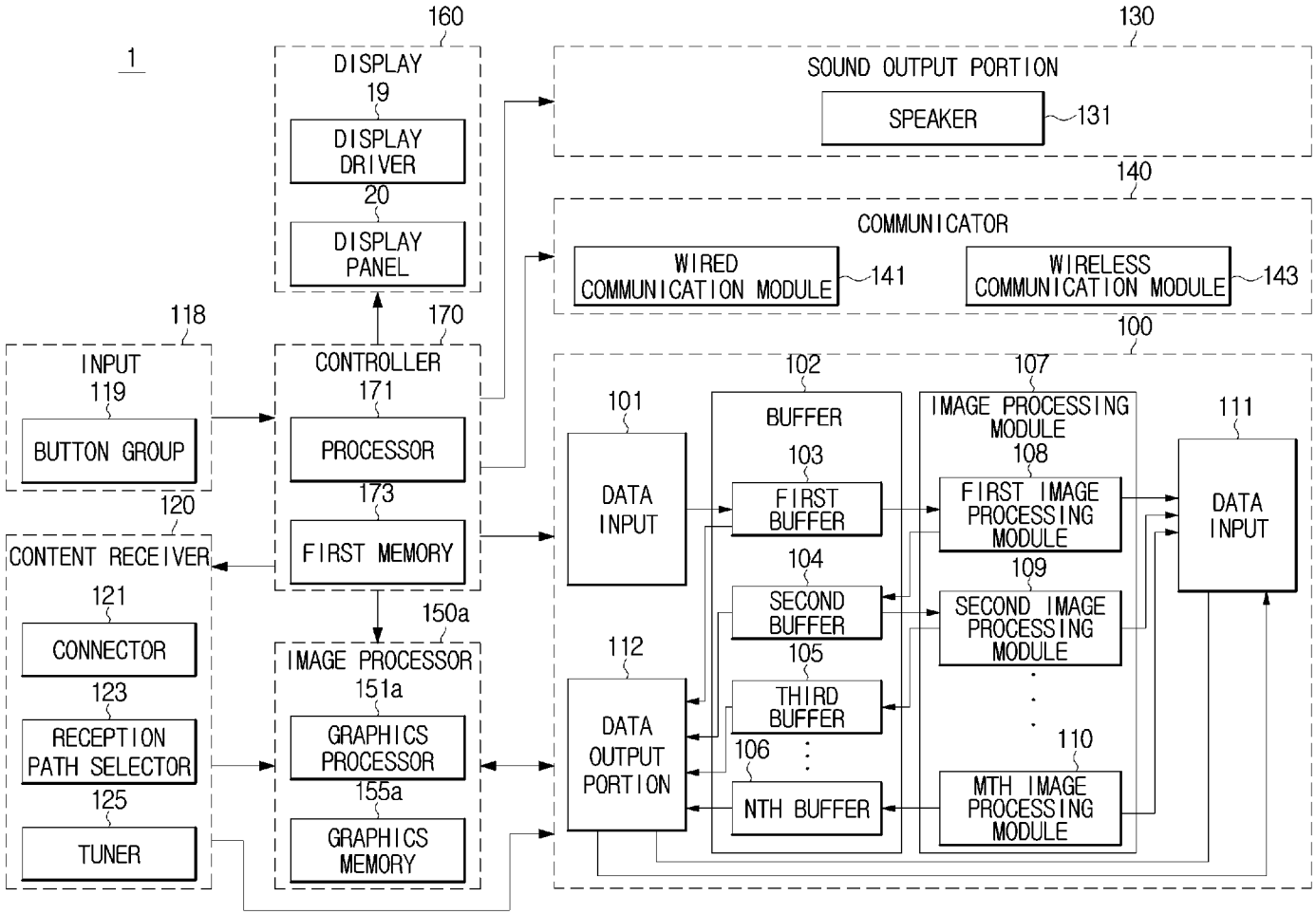
FIGS. 13A and 13B are block diagrams illustrating an example display apparatus in accordance with various example embodiments.
Figure 13B:
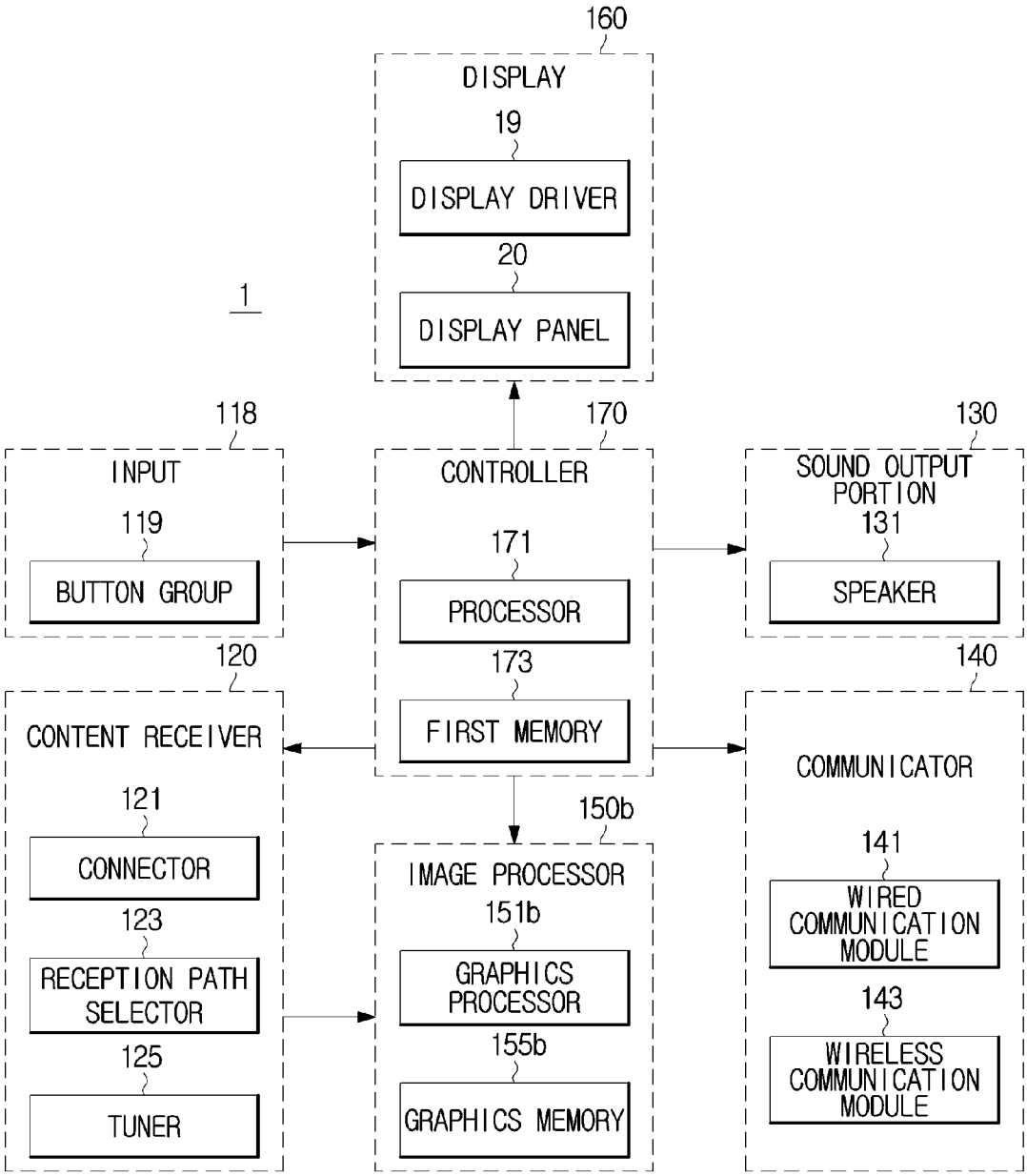

FIG. 12 is a diagram illustrating an example appearance of the display apparatus in accordance with an embodiment of the present disclosure, and FIGS. 13A and 13B are block diagrams illustrating an example display apparatus in accordance with various example embodiments. Hereinafter in order to prevent a repeated description, a description thereof will be described together.

Referring to FIG. 12, the display apparatus 1 may include a body 10 forming an appearance of the display apparatus 1 and accommodating a variety of components forming the display apparatus 1, and a display panel 20 displaying an image to a user.

The display apparatus 1 as illustrated in FIG. 12 may be implemented in a stand type or a wall-mount type according to the supporting method. According to an embodiment, the body 10 may be implemented by a wall-mount type, e.g., installed in a vertical surface, e.g., a wall, using a bracket. According to another embodiment, a stand 3 may be provided in a lower portion of the body 10. The body 10 may be stably disposed on the plane surface by the stand.

On the front side of the body 10, a button group receiving an input of various control commands from a user and a display panel displaying an image according to the user control command may be provided.

A variety of components may be provided in the body 10 for realizing the function of the display apparatus 1. Hereinafter a control block diagram of the display apparatus 1 will be described.

Referring to FIG. 13A, the display apparatus 1 may include an input (e.g., including input circuitry) 118 receiving an input of various control commands from a user, a content receiver (e.g., including content receiving circuitry) 120 receiving a content having images and sound from an external device, a sound output portion (e.g., including sound output circuitry) 130 outputting sound corresponding sound data contained in the content, a communicator (e.g., including communication circuitry) 140 transmitting and receiving various data, e.g., content, through a communication network, an image processor (e.g., including image processing circuitry) 150 and an image processing apparatus (e.g., including image processing circuitry) 100 processing image data contained in the content, a display 160 displaying an image corresponding to image data contained in the content, and a controller (e.g., including processing circuitry) 170 controlling an overall operation of the display apparatus 1.

At least one of the content receiver 120, the communicator 140, the image processor 150, the image processing apparatus 100, and the controller 170 may be integrated in a system on chip (SOC) embedded in the image processing apparatus 100. However, the number of the system on chip (SOC) provided in the image processing apparatus 100 is not limited to one, and thus it is not limited that those is integrated in a single system on chip (SOC).

The input 118 may include various input circuitry and receive a variety of control command from a user.

For example, as illustrated in FIG. 13A, the input 118 may include a button group 119. According to an embodiment, the button group 119 may include a volume button adjusting the size of the sound output from the sound output portion 130, a channel button changing a communication channel that is received by the content receiver 120, and a power button turning on and off the power of the display apparatus 1. In addition, the input 118 may receive a variety of control command from a user through the above mentioned button group 119.

The variety of buttons contained in the button group 119 may employ a push switch and a membrane detecting a pressure of a user or a touch switch detecting a touch of user's body part. However, the type of the button is not limited thereto and thus the button group 119 may employ various input tools outputting an electrical signal corresponding to user's certain motion.

The input 118 may include various input circuitry, including, for example, and without limitation, a remote control configured to receive a user control command remotely, and configured to transmit the user control command to the display apparatus 1. In addition, the input 118 may include well-known various components configured to receive a user control command, but is not limited thereto. When the display panel 20 is implemented by a touch screen type, the display panel 20 may be operated as the input 118.

For example, the input 118 may receive a control command about the display apparatus 1 from a user through the above mentioned button group 119 and remote controller or the display panel 20 formed in a screen type. Accordingly, the input 118 may transmit the received control command to the controller 170, and the controller 170 may control at least one of components of the display apparatus 1 using the control signal. A detail description of the controller 170 will be described in detail.

The content receiver 120 may include various content receiving circuitry and receive a variety of contents from various external devices. For example, the content receiver 120 may receive contents from an antenna receiving a broadcast signal in a wireless communication, a set top box receiving a broadcast signal in a wired and/or wireless communication and converting the received broadcast signal properly, a multi-media playing device (e.g., DVD player, CD player, and blue-ray player) playing contents stored in the multi-media storage media.

For example, the content receiver 120 may include a plurality of connectors 121 connected to the external device, a reception path selector 123 selecting a path, which is to receive content, among the plurality of connectors to receive content, and a tuner 125 selecting a channel (or frequency), which is to receive a broadcast signal, for receiving broadcast signals.

The connector 121 may include a RF coaxial cable connector receiving a broadcast signal containing the contents from the antenna, a high definition multimedia interface (HDMI) connector receiving the content from the set-top box or the multi-media player, a component video connector, a composite video connector and a D-Sub connector.

The reception path selector 123 may select a connector, which is to receive content, among the above mentioned plurality of connectors 121. For example, the reception path selector 123 may automatically select the connector 121 to which the content is received, or manually select the connector 121, which is to receive the content, according to a user control command.

The tuner 125 may extract a transmission signal of a specific frequency (channel), among a variety of signals received through the antenna when receiving broadcast signals. In other words, the tuner 125 may select a channel (or frequency) for receiving content according to a user's channel selection command.

When image data about the selected channel is received via the tuner 125, the image data may be transmitted to the image processor 150. Accordingly, at least one of the image processor 150*a* and the image processing apparatus 100 may obtain color data and image control signal from the image data through an image processing, and the display 160 may restore the image on the display panel 20 based on the color data and the image control signal.

Further, the display apparatus 1 may be provided with the sound output portion 130.

The sound output portion 130 may include various circuitry and receive sound data from the content receiver 120 in response to a control signal of the controller 170. The sound output portion 130 may include one or more speaker 131 converting an electrical signal into an acoustic signal.

As illustrated in FIG. 13A, the display apparatus 1 may be provided with the communicator 140. The communicator 140 may include various communication circuitry and support a variety of communication systems by having a wireless communication module 141 supporting a wireless communication system and a wired communication module 143 supporting a wired communication system.

Communication system may include a wireless communication system and a wired communication system. The wireless communication system refers to a communication system configured to transmit and receive a signal containing data via a wireless manner. At this time, the wireless communication system may include 3Generation (3G), 4Generation (4G), Wireless LAN (WLAN), Wi-Fi, Bluetooth, ZigBee, Wi-Fi Direct (WFD), Ultra wideband (UWB), infrared data association (IrDA), Bluetooth Low Energy (BLE), Near Field communication (NFC), or Z-wave, but is not limited thereto.

The wireless communication system may refer, for example, to a communication system configured to transmit and receive a signal containing data via a wired manner. For example, the wired communication system may include Peripheral Component Interconnect (PCI), PCI-express, and Universe Serial Bus (USB), but is not limited thereto. The controller 170 may control an operation of the communicator 140 through a control signal to download a variety of contents via the wired network or the wireless network, thereby providing the content to a user.

The wired communication module 141 and the wireless communication module 143 may be implemented in a single chip, respectively. However, the implementation of the communication module is not limited thereto. Therefore, the wired communication module 141 and the wireless communication module 143 may be integrated in a single chip.

Referring to FIG. 13A, the display apparatus 1 may be provided with an image processor 150*a*. The image processor 150*a* may include various image processing circuitry and perform an image processing on image data contained in the content received from the content receiver 120 or the communicator 140.

As illustrated in FIG. 13A, the image processor 150*a* may include a graphics processor 151*a* and a graphics memory 155*a*. The graphics processor 151*a* and the graphics memory 155*a* may be implemented in separate chips, respectively. However, the graphics processor 151*a* and graphics memory 155*a* are not limited to being implemented as separate chips, respectively, and thus the graphics processor 151*a* and the graphics memory 155*a* may be implemented as a single chip.

The graphics memory 155*a* may memorize image processing programs for the image processing and processed color data or temporarily memorize image information output from the graphics processor 151*a* or image information received from the content receiver 120. In addition, in the graphics memory 155*a*, data related an application program and an algorithm for analyzing color pattern of the color data.

The graphics processor 151*a* may obtain a variety of data needed for restoring an image by processing the image data stored in the graphics memory 155*a* using the image processing program memorized in the graphics memory 155*a*. For example, the graphics processor 151*a* may obtain an image control signal and color data by performing the image processing on image data among the contents stored in the graphics memory 155*a*.

The image processor 150*a* and the image processing apparatus 100 may be separately provided on the display apparatus 1, as illustrated in FIG. 13A. Besides, an image processing process performed in the image processing apparatus 100, various image processing for displaying an image on the display panel 20 may be performed by the image processor 150*a*.

For another example, the image processing apparatus 100 may be contained in an image processor 150*b*, as illustrated in FIG. 13B. In a graphics memory 155*b* of the image processor 150*b*, programs and data for the image processing process for the image quality improvement may be stored, and the image processor 150*b* may integrally perform the above mentioned image processing process and other image processing via the calculation process. Except that a subject of the operation is changed, the operation of the image processing process may be the same as the above mentioned description, and thus a detail description thereof will be omitted.

The display apparatus 1 may be provided with the display 160. Referring to FIG. 2, the display 160 may include a display driver 19 and the display panel 20.

The display driver 19 may receive image data from the image processor 150 or the image processing apparatus 100 according to the control signal of the controller 170, and drive the display panel 20 so that the display panel 20 may display an image corresponding to the received data. A detail description of the controller 170 will be described later.

The display panel 20 may be implemented by a cathode ray tube (CRT) display panel, a liquid crystal displays (LCD) panel, a light emitting diode (LED) panel, an organic light emitting diode (OLED), a plasma display panel (PDP), or a field emission display (FED) panel, but is not limited thereto.

The display panel 20 may comprise a plurality of pixels. Pixel is the smallest unit constituting an image to be displayed on the display panel 20 and referred to as a dot. Hereinafter for convenience of description, pixel will be collectively used for the description. Each pixel may receive an electrical signal indicating image data and output an optical signal corresponding to the received electric signal. Thus, the optical signal output from the plurality of pixels contained in the display panel 20 may be combined and thus image data may be displayed on the display panel 20.

The controller 170 may be provided in the display apparatus 1. The controller 170 may include a processor 171 and a memory 173, as illustrated in FIG. 13A.

The memory 173 may store control programs and control data for controlling the operation of the display apparatus 1, and temporarily memorize control command input via the input 118 or control signal output by the processor 171.

The processor 171 may include various processing circuitry and control the overall operation of the display apparatus 1. The processor 171 may generate control signals for controlling each component of the display apparatus 1 to control the operation of each of the component.

For example, the processor 171 may control the communicator 140 through a control signal so that the communicator 140 may send and receive a signal including data to and from an external device. According to another embodiment, the processor 171 may transmit a control signal to the sound output portion 130 in response to a sound control command input through the input 118, so as to allow the size of the sound output through the speaker 151 to be regulated.

For another example, the processor 171 may control at least one of the image processor 150*a* and the image processing apparatus 100 so that at least one of the image processor 150*a* and the image processing apparatus 100 may perform an image processing on the content received from the content receiver 120, and the processor 171 may control the display 160 so that the display 160 displays the processed image.

According to an embodiment, the processor 171 may control the image processing apparatus 100 through a control signal to allow the image processing process to be performed so that the image quality of the content received from the content receiver 120 is improved. The processor 171 may control the display 160 through the control signal so that the display 160 displays an image having an improved image quality.

The processor 171 may process a various data stored in the memory 173, according to the control program memorized in the memory 173. Hereinbefore the processor 171 and the memory 173 have been described to be separate chips, respectively. However, the configuration of the processor 171 and the memory 173 is not limited thereto and thus the processor 171 and the memory 173 may be implemented as a single chip.

Some or all of components of the image processor 150*a* of FIG. 13A or some or all of components of the image processor 150*b* of FIG. 13B may be included in the controller 170. That is, the controller 170 may integrally or partially perform the operation of the image processor 150*a* of FIG. 13A or the operation of the image processor 150*b* of FIG. 13B, but is not limited thereto. Since only the subject of the above mentioned operation is switched from the image processor 150*a* and 150*b* or the image processing apparatus 100 to the controller 170 while the operation is the same, a detail description will be omitted.

Except that the image processing apparatus 100 of FIG. 13A is separated from the image processor 150*a* and the image processing apparatus 100 of FIG. 13B is contained in the image processor 150*a*, the image processing apparatus 100 of FIG. 13A and the image processing apparatus 100 of FIG. 13B may be the same, and thus a detail description of the image processing apparatus 100 of FIG. 13B will be omitted. Hereinafter an operational flow of the image processing apparatus 100 and the display apparatus 1 will be described.

Figure 14:
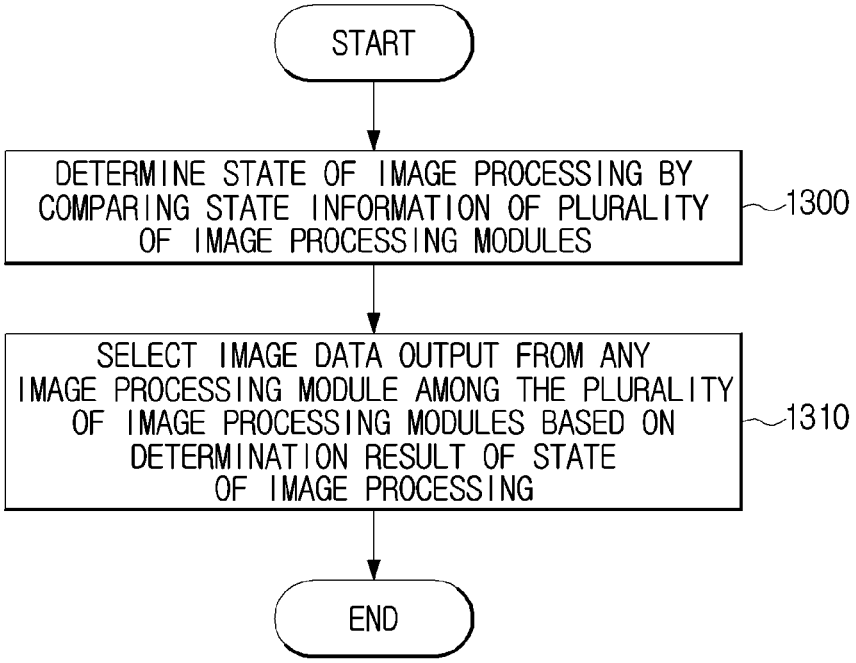
FIG. 14 is a flowchart illustrating an example method of operating an image processing apparatus in accordance with an example embodiment.

FIG. 14 is flowchart illustrating an example method of operating an image processing apparatus in accordance with an example embodiment.

The image processing apparatus may compare the state information of the plurality of image processing modules to determine an image processing condition (1300). The image processing apparatus may improve the image quality by a series of image processing process, e.g., decoding, the noise reduction, and the contrast enhancement.

The image quality of the image data may be gradually improved as passing through the plurality of image processing modules. Therefore, image data about the same position may be stored in any one buffer and at least another buffer among a plurality of buffers connected to the plurality of image processing modules, wherein the only difference between both image data is the image quality.

According to an embodiment, the image processing apparatus 100 may determine whether the image processing is performed in a normal manner, e.g., the real time processing condition is met, based on the state information of the plurality of image processing modules. A method of obtaining the state information of the image processing module has been described and thus a description thereof will not be repeated.

The image processing apparatus 100 may select image data output from any one image processing module among the plurality of image processing modules, based on the determination result of the state of image processing, and output the selected image data (1310).

For example, when the real time processing condition is met, the image processing apparatus may select image data having the most improved image quality, receive the image data from the buffer, and output the image data. However, in a state in which image data of a certain line is required to be output, when the real time processing condition is not met, the image processing apparatus may select image data having the most improved image quality, from image data of the certain line stored in another buffer, receive the image data from the buffer, and output the image data.

According to an embodiment, the image processing apparatus is provided with the buffer storing image data output from the plurality of image processing modules, and thus it may be possible to prevent the visual artifacts in which image data of the same line is repeatedly displayed on the image. According to an embodiment, the image processing apparatus may output image data having the most improved image quality among image data stored in the buffer, thereby securing the image quality of the image as long as possible.

Figure 15:
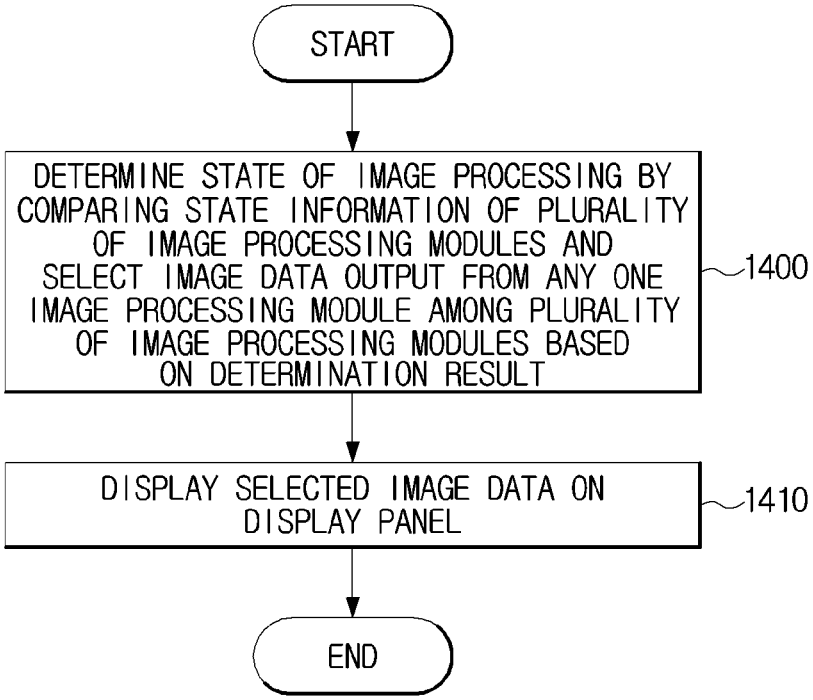
FIG. 15 is a flowchart illustrating an example method of operating the display apparatus in accordance with an example embodiment of the present disclosure.

FIG. 15 is a flowchart illustrating an example method of operating the display apparatus in accordance with an example embodiment of the present disclosure.

The display apparatus may determine the state of the image processing by comparing the state information of the plurality of image processing processes, and select image data output from any one image processing module among the plurality of image processing modules, based on the determination result (1400). As mentioned above, the image processing apparatus may be embedded in the display apparatus. The image processing apparatus may be contained in the image processor of the display apparatus or the image processing apparatus may be separated from the image processor and thus the image processing apparatus may perform the image processing process with the image processor by dividing the image processing process. A description related to the step 1400 may be the same as the step 1300 and 1310 and thus a detail description thereof will be omitted.

The image processing apparatus may display the selected image data on the display panel (1410). For example, when the selected image data is output through the image processor or the output terminal of the image processing apparatus, the display driver of the display apparatus may receive the output image data and control the display panel so that the display panel displays an image corresponding to the received image data.

As is apparent from the above description, according to the proposed image processing apparatus, display apparatus and method of controlling of the display apparatus, it may be possible to prevent and/or reduce the rapid decrease in the image quality of the image data although the real time processing condition is not met.

As is apparent from the above description, according to the proposed image processing apparatus, display apparatus and method of controlling of the display apparatus, it may be possible to set the image processing process using the history information generated by collecting the state information, and thus it may be possible to perform the image processing process efficiently while preventing and/or reducing the overload of the calculation.

Although various example embodiments of the present disclosure have been illustrated and described, it will be appreciated by those skilled in the art that changes may be made in these embodiments without departing from the principles and spirit of the disclosure, the scope of which is defined in the claims and their equivalents.

What is claimed is:

1. A display apparatus comprising:

a plurality of image processing modules arranged in series with each other and each comprising image processing circuitry configured to perform an image processing process on an input image data or an image data output from a preceding image processing module;

a controller configured to determine whether an image processing state is in a normal state based on whether an image data about a region to be output is output from an image processing module connected last in series among the plurality of image processing modules, to identify one image processing module, of the plurality of image processing modules arranged in series, outputting the image data based on state information when it is determined that the image processing state is not the normal state, and to receive the image data from a buffer storing image data output from the one image processing module from among buffers connected to the plurality of image processing modules wherein the image data processed by the one image processing module is not processed by at least another one of the plurality of image processing modules while bypassing the at least another one of the plurality of image processing modules; and a display configured to display the image data, wherein the state information indicates information on an image data output from a corresponding image processing module.

2. The display apparatus of claim 1, wherein each of the plurality of image processing modules are connected to a respective buffer storing image data, and the controller is configured to select any one buffer of the buffers connected to the plurality of image processing modules based on the state information of the plurality of image processing modules, and to output image data stored in the selected buffer.

3. The display apparatus of claim 1, wherein the controller is configured to receive state information from the plurality of image processing modules, and to determine whether the image processing state is in the normal state by comparing the received state information, wherein the normal state is a state in which the image data about the region required to be output is output normally.

4. The display apparatus of claim 1, wherein the controller is configured to estimate a workload using the state information of the plurality of image processing modules, and to set a complexity of the image processing process based on the estimated workload.

5. The display apparatus of claim 1 further comprising:

a buffer connected to the plurality of image processing modules and configured to receive image data processed by the plurality of image processing modules, and to store the image data, wherein when image data corresponding to a same region as image data pre-stored in the buffer is input from at least one of the plurality of image processing modules, the controller is configured to replace the image data pre-stored in the buffer with the image data corresponding to the same region.

6. The display apparatus of claim 1, wherein the plurality of image processing modules are configured to perform different respective image processing processes.

7. A control method of a display apparatus, the method comprising:

providing a plurality of image processing modules each comprising image processing circuitry configured to perform an image processing process on an input image data or an image data output from a preceding image processing module;

determining whether an image processing state is in a normal state lased on whether an image data about a region required to be output is output from an image processing module connected last in series among the plurality of image processing modules;

identifying one image processing module of the plurality of image processing modules arranged in series, outputting the image data based on state information when it is determined that the image processing state is not the normal state;

receive the image data fro a buffer storing image data output from the one image processing module from among buffers connected to the plurality of image processing modules of the plurality of image processing modules, wherein the output image data about the region processed by the one image processing module is not processed by at least another one of the plurality of image processing modules while bypassing the at least another one of the plurality of image processing modules; and displaying the image data, wherein the state information indicates information on an image data output from a corresponding image processing module.

8. The control method of claim 7, wherein each of the plurality of image processing modules are connected to a respective buffer storing image data, and the outputting further comprises selecting any one buffer among the buffers connected to the plurality of image processing modules based on the state information of the plurality of image processing modules, and outputting image data stored in the selected buffer.

9. The control method of claim 7, wherein the outputting further comprises determining whether the image processing state is in the normal state by receiving the state information from the plurality of image processing modules and by comparing the received state information, wherein the normal state is a state in which the image data about the region required to be output is output normally.

10. The control method of claim 7, wherein the plurality of image processing modules are connected to a buffer receiving image data processed by the plurality of image processing modules and storing the image data, and the outputting further comprises, when image data corresponding to a same region as image data pre-stored in the buffer is input from at least one of the plurality of image processing modules, determining whether the image data pre-stored in the buffer is to be replaced with the image data corresponding to the same region based on an image processing level.

11. The control method of claim 7, wherein the plurality of image processing modules are connected to a respective plurality of buffers receiving image data processed by the plurality of image processing modules, respectively, and storing the image data.

* * * * *